US011559096B1

(12) United States Patent
Tessler

(10) Patent No.: US 11,559,096 B1
(45) Date of Patent: Jan. 24, 2023

(54) WEIGH FED GARMENT TABS

(71) Applicant: Jillian Tessler, New York, NY (US)

(72) Inventor: Jillian Tessler, New York, NY (US)

( * ) Notice: Subject to any disclaimer, the term of this patent is extended or adjusted under 35 U.S.C. 154(b) by 262 days.

(21) Appl. No.: 16/985,823

(22) Filed: Aug. 5, 2020

Related U.S. Application Data

(63) Continuation-in-part of application No. 16/212,985, filed on Dec. 7, 2018, now Pat. No. 11,406,150.

(51) Int. Cl.
*A41F 17/00* (2006.01)

(52) U.S. Cl.
CPC ..... *A41F 17/00* (2013.01)

(58) Field of Classification Search
CPC ..... A41F 17/00; A41F 17/02
See application file for complete search history.

(56) References Cited

U.S. PATENT DOCUMENTS

| | | | |
|---|---|---|---|
| 268,769 | A | 12/1882 | Brooks |
| 269,154 | A | 12/1882 | Brooks |
| 614,189 | A | 11/1898 | Waitzfelder |
| 970,175 | A | 9/1910 | Brooks |
| 1,084,233 | A | 1/1914 | Roarke |
| 1,098,678 | A | 6/1914 | Morley |
| 1,099,931 | A | 6/1914 | Paull |
| 1,388,802 | A | 8/1921 | Cooper |
| 3,107,361 | A | 10/1963 | Glutting, Sr. |
| 3,237,261 | A | 3/1966 | Homonoff |
| 3,531,835 | A | 10/1970 | Paikin |
| 3,947,896 | A | 4/1976 | Taylor |
| 4,139,912 | A | 2/1979 | Thuaud |
| 4,723,326 | A | 2/1988 | Tarlow et al. |
| 5,517,722 | A | 5/1996 | Bender |
| 5,785,181 | A | 7/1998 | Puartararo, Jr. |
| 6,458,440 | B1 | 10/2002 | Merritt |
| D490,216 | S | 5/2004 | Powell |
| 7,503,079 | B1 | 3/2009 | Fletcher et al. |
| 7,900,277 | B1 | 3/2011 | P'Brien et al. |
| 8,153,221 | B1 | 4/2012 | MacKinnon |
| 8,370,964 | B1 | 2/2013 | Kaper |
| 8,393,015 | B2 | 3/2013 | Jones |
| 8,695,193 | B2 | 4/2014 | Kress et al. |
| 8,695,194 | B2 | 4/2014 | Kress et al. |
| 9,351,528 | B2 | 5/2016 | Grimes et al. |
| 2008/0189831 | A1 | 8/2008 | Jones |
| 2011/0117317 | A1 | 5/2011 | Kress et al. |
| 2012/0011637 | A1 | 1/2012 | Fries |

(Continued)

OTHER PUBLICATIONS

U.S. Appl. No. 16/212,985, Restriction Requirement, dated Jun. 11, 2021.

(Continued)

*Primary Examiner* — Richale L Quinn
(74) *Attorney, Agent, or Firm* — Allan A. Fanucci

(57) ABSTRACT

A weighted garment tab in the form of a weighted disk that has a fabric-safe and reusable adhesive on the back surface. The adhesive generally includes a cover or release member that protects it before application to the garment. This tab has a smooth, hard finish that does not catch onto or snag onto the dress fabric and is smaller, flatter, and smoother compared to the prior art devices mentioned above, so that it is much less noticeable to the wearer during use. Also, a method of preventing upward movement of a garment in an air current by applying one or more tabs onto the hem or lower portion of the inside of the garment.

20 Claims, 3 Drawing Sheets

(56) References Cited

U.S. PATENT DOCUMENTS

| | | | |
|---|---|---|---|
| 2012/0137412 | A1 | 6/2012 | Jones |
| 2013/0104291 | A1 | 5/2013 | Daniel |
| 2014/0352031 | A1 | 12/2014 | Choi et al. |
| 2016/0174643 | A1 | 6/2016 | Miller et al. |
| 2017/0079353 | A1 | 3/2017 | Mann et al. |
| 2018/0055120 | A1 | 3/2018 | Gall-Krasnick |
| 2019/0191802 | A1 | 6/2019 | Dunn et al. |
| 2019/0364999 | A1 | 12/2019 | Baschak et al. |
| 2020/0224067 | A1 | 7/2020 | von Wedel-Parlow |
| 2020/0359725 | A1 | 11/2020 | Harrington |

OTHER PUBLICATIONS

U.S. Appl. No. 16/212,985, Non-Final Rejection, dated Aug. 18, 2021.

U.S. Appl. No. 16/212,985, Final Rejection, dated Feb. 9, 2022.

U.S. Appl. No. 16/212,985, Advisory Action, dated Apr. 20, 2022.

U.S. Appl. No. 16/212,985, Notice of Allowance, dated Jun. 3, 2022.

Dress Downs, The First Dress Weights, "Designed to keep your dress down and head high when the wind blows," retrieved from the Internet Dec. 3, 2018, 3 pgs.; hllps://www.garmentweighl.com/.

Dress Weights by DressStrong, "A Windy Day Fashion Fix," retrieved from the Internet Dec. 3, 2018, 3 pgs; https://www.dressstrong.com/.

WEIGH FED GARMENT TABS

CROSS-REFERENCE TO RELATED APPLICATIONS

This application is a continuation-in-part of U.S. application Ser. No. 16/212,985 filed Dec. 7, 2018, the entirety of which is herein incorporated by reference.

BACKGROUND

The present invention is a weighted garment tab for use primarily on dresses, skirts, and tops to prevent updrafts from moving the hem of the dress, skirt, or top upwards, sideways or into any other incorrect position. One or more weighted garment tabs applied to the hem of a dress, skirt, or top will provide sufficient additional resistance to such movements of the garment. Also, the tabs have an adhesive that has sufficient adhesiveness to stick to most fabrics including silk while also being removable to be re-positioned on one garment or to be removed and used on a different garment or clothing item.

A particular issue when wearing a skirt, dress, or top on a windy day is that it sometimes can become a struggle to keep the lower portion and hem in position to prevent them from moving upwards along with air currents. Even an isolated breeze or wind gust can cause the hem of these garments to move upward and cause embarrassment for the wearer. Accordingly, there is a need for a device that can provide resistance to such upward movements of these garments.

This is not a new problem, and the prior art has addressed it in the past with various potential solutions. It is known to pin a weight to a dress hem (US 2013/0104291), but this requires making a hole in the garment. To avoid damaging the garment, US 2012/0011637 utilizes a pair of magnets for holding a weight onto the hem of a dress, skirt, blouse or other article of clothing. The magnetic part that is placed on the outside of the dress is of course visible to others thus detracting from the appearance of the garment. Another solution to avoid damaging the garment is to use a clip to attach a weight (U.S. Pat. No. 9,351,528), but the device of this patent is bulky and also is visible on the outer side of the hem. U.S. Pat. No. 8,393,015 provides a clip that is attached to the inside of the dress but this again is bulky and includes a hanging weight that move to contact the wearer's leg when walking. It is also known to sew weights into the hem of a slip (U.S. Pat. No. 7,900,277) but such weights are not removable and can cause issues when the garment is laundered.

More recently, there are certain commercially available hem weights that are secured to the inside hem of a dress or skirt by an adhesive (see dressdowns.com and garmentweights.com). These devices are also thick and bulky and provide an uncomfortable clunky feeling against the wearer's legs when walking.

Thus, there still remains a need for a less conspicuous, less obtrusive, and versatile garment weight and this is now provided by the present invention. Embodiments of the present invention further provide a portable kit for storing and transporting weighted garment tabs in a convenient form factor.

SUMMARY OF THE INVENTION

Now, therefore, the present invention provides a weighted garment tab that is essentially a weighted disk that has a fabric-safe and reusable adhesive on the back surface. The adhesive generally includes a release layer or backing member that protects it before application to the garment. This tab has a smooth, hard finish that does not catch onto or snag onto the fabric of the garment and is smaller, flatter, and smoother compared to the prior art devices mentioned above, so that it is much less noticeable to the wearer or others during use.

The disk can be provided in any pantone color. While black, grey or white are often used due to their universal nature, the disk color can be selected to match the color of the garment to which it is to be applied. Also, multiple disks will be applied, preferably four or more if desired, positioned and spaced around the hem on the inside of the garment so that they are hidden.

The invention also provides a method of minimizing or eliminating a garment from lifting due to air movement which comprises attaching one or more weighted garment tabs as disclosed herein to a lower portion of the garment so that the weight of the tab(s) provide resistance to upward movement of the garment.

The invention further provides a kit for storing and carrying weighted garment tabs. The kit includes a carrying case, one or more weighted garment tabs, and an insert configured to snugly fit into the carrying case and having one or more cavities configured to accommodate the one or more weighted garment tabs. The invention may also be directed to the carrying case. Methods are also contemplated and would be understood from the description.

BRIEF DESCRIPTION OF THE DRAWINGS

Various features of examples and embodiments in accordance with the principles described herein may be more readily understood with reference to the following detailed description taken in conjunction with the accompanying drawings, where like reference numerals designate like structural elements, and in which.

DETAILED DESCRIPTION OF THE INVENTION

Figure 1:
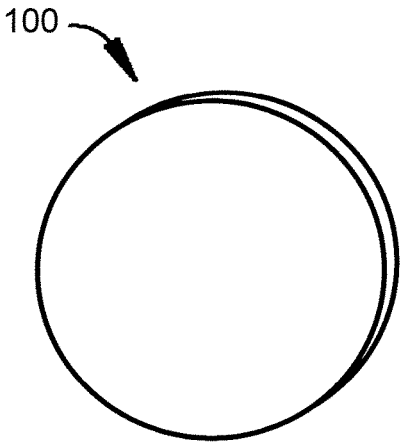
FIG. 1 is a front view of a weighted garment tab in accordance with the present invention.

The weighted garment tabs and method of use thereof according to the present invention represent a significant improvement to what is known in the art. First of all, the weighted garment tabs are configured to be relatively compact, thin, and smooth so that they do not cause any damage went contacting or sliding upon the garment fabric. Also, the adhesive that is used is capable of universal attachment to any type of fabric in a secure yet removable and fabric-safe manner. The compact nature of the device allows it to be worn both inconspicuously from view as well as in a manner that does not interfere with the wearer when walking. For a dress or skirt, the tabs keep the hem down and in position, while for a blouse or shirt, the tabs keep the top in place so that the hem of a top does not move around during walking or other movements. They also help resist a flowy top from moving upwards or sideways.

In particular, the weighted garment tab of the present invention consists of:

a circular, solid steel disk having front and back surfaces, a diameter of between 25 and 40 mm, a peripheral edge, a thickness of between 2 and 2.5 mm and a weight of between 13 and 16 grams;

a coating of a rubberized paint uniformly covering the edges and both surfaces of the disk, the rubberized paint providing a smooth and hard low friction surface;

a reusable fabric adhesive applied onto one surface of the disk and covering an area of 50 to 93.75% of that surface of the disk; and an optional but preferred release layer or backing member covering the adhesive.

The disk has a preferred diameter of between 32 and 38 mm, a preferred thickness of between 2.1 and 2.3 mm, and a preferred weight of between 14.5. and 15.5 grams. The adhesive preferably has a diameter of between 25 and 30 mm and covers 65.79 to 93.75% and preferably 77.31 to 78.94% of the surface of the disk. Thus, the peripheral portion has an area of 6.25 to 34.21% of the first surface of the disk.

Turning now to the drawings, FIG. 1 illustrates the front surface of weighted garment tab 100. As noted herein, this tab has relatively flat and smooth surfaces by virtue of the coating that is applied to the underlying steel disk. The front surface is smooth and if desired could include a product name or other advertising information.

Figure 2:
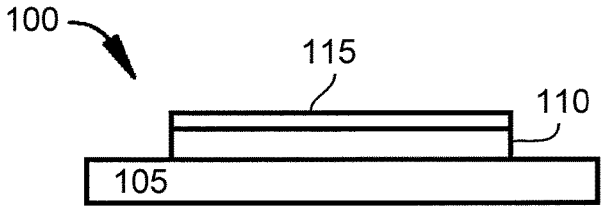
FIG. 2 is a side view of the weighted garment tab of FIG. 1.

Although not shown to exact dimensions, FIG. 2 illustrates a side view of the device to illustrate the disk thickness 105, the location of the adhesive layer 110 and the location of the optional release layer or backing member 115. The backing member can be substituted by a support structure as disclosed herein below.

Figure 3:
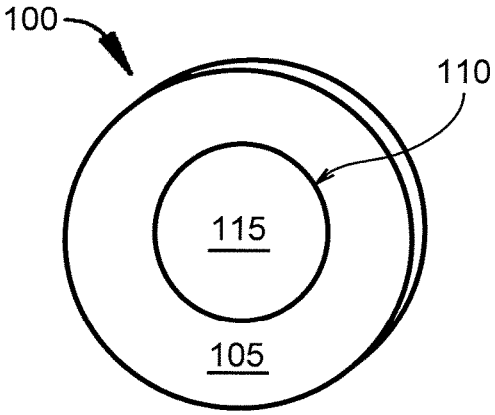
FIG. 3 is a back view of the weighted garment tab of FIG. 1.

FIG. 3 illustrates the location of the adhesive and backing member on the back surface of the disk. The adhesive is provided in a generally central location although it can be placed anywhere on the back surface of the tab 100. Typically, the adhesive is placed in the center of the disk and is a circular spot having a diameter of between 25 and 30 mm.

Figure 4:
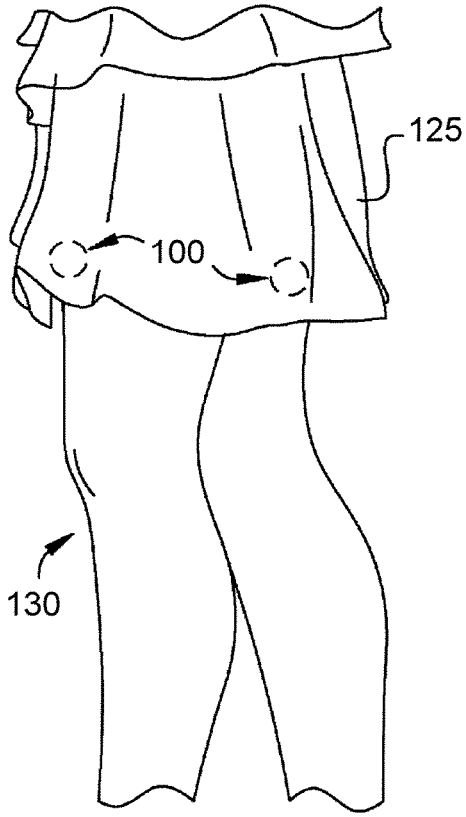
FIG. 4 is a view of a dress hem that includes a plurality of weighted garment tabs attached thereto.

FIG. 4 illustrates a garment in the form of a dress 125 that includes two weighted garment tabs 100 secured to the inside of the dress hem. The tabs provide resistance to upward movement of the dress hem away from the wearer's legs 130. Any desired number of tabs can be used depending upon the garment fabric and weight. The lighter fabrics would generally use more to assure sufficient resistance against upward movement.

The details of a most preferred embodiment of the invention includes the following:

material of disk: a thin and flat carbon steel size of disk: 34.925 mm (1.375 inches) in diameter by 2.2 mm in thickness weight: 14.5 grams (+/−5% tolerance)

adhesive material: 3M 9495 LSE available from 3M: this is a double sided polyester (polyethylene terephthalate) tape that has layers of an adhesive that sticks to plastic and rubber coatings as well as to most fabrics. The adhesive is reusable and fabric-safe. In particular, it is safe on silk garments.

the size of the adhesive is 27 mm in diameter and it is placed in the center of the back surface of the disk. It covers 77.31% of the surface of the disk and the adhesive-free peripheral portion has an area of 22.69%.

the disk has a coating of rubberized paint to provide a hard, smooth coating.

the pain can be of any particular color, as desired.

Both surfaces of the disk are flat as is the peripheral edge. The corners between the surfaces and edge are preferably slightly rounded for greatest smoothness. The back of the disk receives a fabric-safe adhesive and if desired for individual sale, a release layer or backing member (generally of paper or a plastic film) which protects the adhesive until the tab is to be applied to a garment hem. At that time, the backing member is removed and the disk is applied to the back of the hem on the inside of the dress so that it is not visible when being used.

Figure 5:
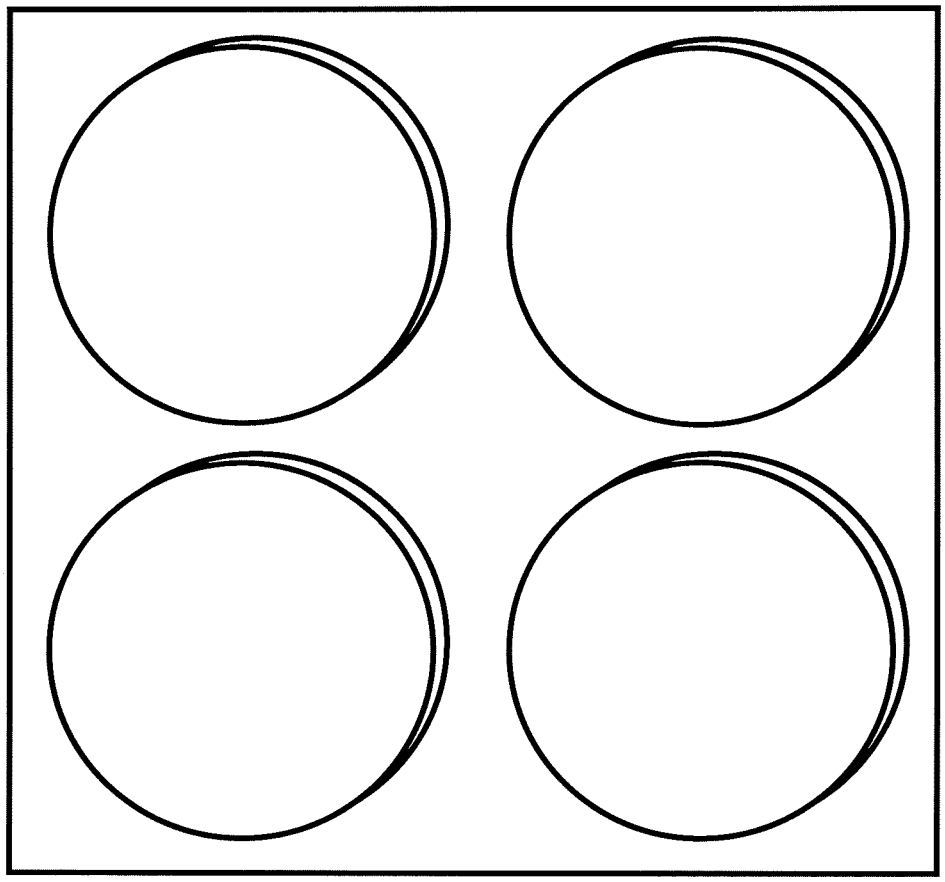
FIG. 5 is a perspective view of a package for holding multiple garment tabs.

Alternatively, when a plurality of tabs is to be sold together, these can be mounted on a plastic or treated cardboard sheet with the tabs arranged in an array and adhered to the sheet. The plastic sheet or treated cardboard sheet holds the tabs but allows their easy removal when the tabs are to be applied to a garment. An array of tabs, e.g., 2 by 2, 4 by 4, 4 by 8, 6 by 6 etc., on the sheet provides greater numbers of tabs for use on one or more garments while also providing a convenient support for storage and adhesive maintenance of unused tabs. A 2 by 2 array of tabs on a PVC plastic sheet is illustrated in FIG. 5.

The weighted garment tab can be used on any type of garment but preferably would be used on a dress, skirt, blouse or shirt. A number of these tabs could be applied as need with at least four generally being sufficient. If desired, up to 12 tabs can be used on lighter fabrics.

The fabric-safe adhesive is one that provides good strength and attachment to various fabrics (including silk) but is removable when the dress garment is to be washed or dry cleaned. The preferred adhesive is reusable and can be attached to and removed from silk fabric without damaging the fabric. This renders the invention more versatile that it is expected to work well on any type of fabric. This adhesive is also useful to allow the tabs to be removed from one garment to another if desired.

Figure 6A:
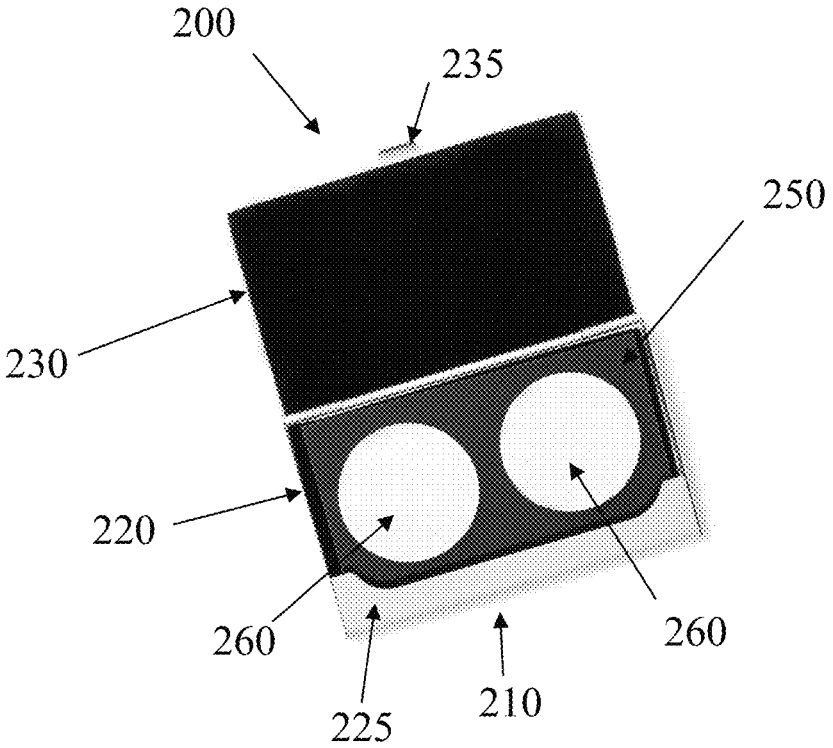
FIG. 6A is a view of components of garment tab kit in accordance with the present invention.
Figure 6B:
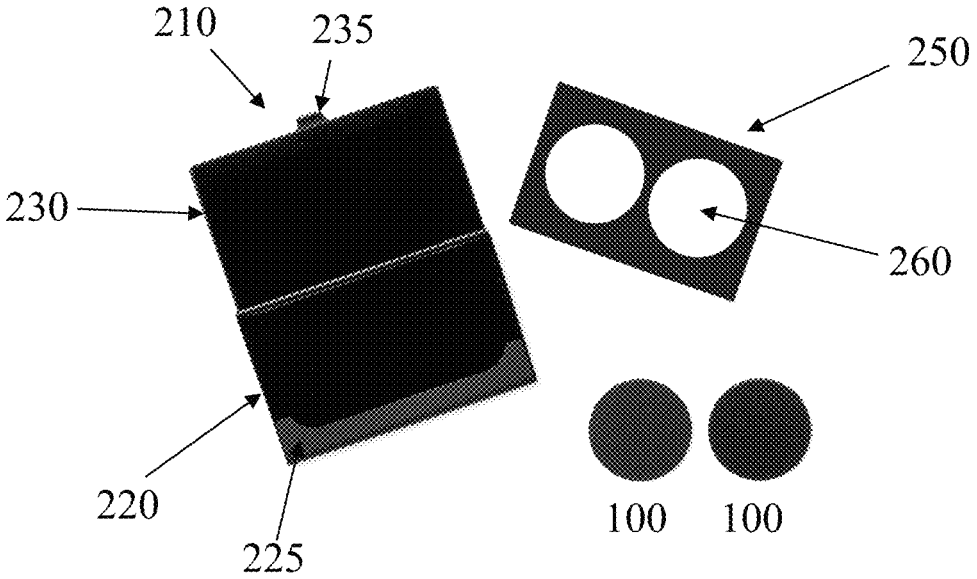
FIG. 6B is another view of components of garment tab kit in accordance with the present invention.

Embodiments of the present invention further disclose a kit 200 for weighted garments tabs for use on garments to prevent unwanted motion. The garment tab kit 200 enables the storage and transportation of garment tabs 100 in a carrying case having a convenient form factor. FIG. 6A illustrates components of a garment tab kit 200 according to an embodiment of the present invention. FIG. 6B also illustrates components of a garment kit 200 according to an embodiment of the present invention. The garment tab kit 200 comprises a carrying case 210 and one or more garment tabs 100, and an insert 250.

The carrying case 210 is configured to receive garment tabs 100. Generally, the carrying case 210 may be a flat container. The carrying case 210 may have rectangular, square, oval, circular shape, for example. Preferably, the carrying case 210 is large enough to hold multiple garment tab 100 having the dimensions previously described for garment tabs 100, while remaining small enough to fit in a generic pocket or purse. In the embodiment illustrated, the carrying case 210 is a flat, rectangular receptacle configured to hold at least one garment tab 100. In a preferred embodiment, the carrying case 210 is dimensioned to receive four garment tabs 100. The carrying case 210 may be made of plastic, metal or any other suitable material.

The carrying case 210 may comprise a body portion 220 and a cover portion 230. The body portion 220 may be defined by sidewalls and a bottom wall that form the receptacle for the garment tabs 100. In the embodiment illustrated, the body portion 220 of the carrying case 210 has four sidewalls. The carrying case 210 further comprises a cover portion 230. The cover portion serves to close the carrying case 210 and is hingedly attached thereto. In FIGS. 6A and 6B, the cover portion 230 is connected to the carrying case 210 at a hinge that extend the length of the sidewall. In some embodiments, the cover 230 may be removable from the body portion 220 of the carrying case. The case 210 can be adapted to include a small lip, protrusion, or knob 235, as shown, on the cover 230 that assist the user in opening the case. The case 210 may be structured to provide a generally open area for accessing the tabs 100 or insert 250. For example, as shown, when the cover is open, the case 210 is adapted to provide a pocket with a front wall 225 that extends a portion of the way up towards the top of the case but does not substantially cover the front side of the case 210. Other case types or configuration are contemplated such as a generally flat envelop structure.

The carrying case 210 further comprises an insert 250. The insert 250 is configured to hold or provide support for the garment tabs 100, immobilize them, and prevent them from rattling around the carrying case 210. The garment tabs may be applied to the insert 250 with their adhesive sides, in some embodiments. In some embodiments, the insert 250 can also serve as a dampening material to protect the garment tabs 100 against shocks or movement (e.g., generally being loose which can make them easy to lose or difficult to use). To that end, the insert 250 may be made of foam, cardboard, or any other dampening material. In some embodiments, the insert is further configured to preserve the adhesive properties of the garment tabs 100 installed in it. In particular, the insert 250 serves as a large adhesive cover in lieu of individual release layers or backing members or protective labels (generally of paper or a plastic film) which protects the adhesive before the tab 100 is applied to a garment hem for the first time. To that end, the insert may be made of a synthetic plastic polymer such as PVC (polyvinyl chloride) or any other material that may help preserve the adhesive properties of the garment tabs. The ability of the insert 250 to maintain the stickiness of the adhesive on the tabs 100 alleviates the need to keep and re-apply the protective labels of the tab's adhesives after use. It should be noted that the insert 250 may be configured to provide both dampening protection and adhesive protection to the garment tabs, in some embodiments.

In some embodiments, the insert may have the size and shape of the interior of the body portion 220 of the carrying case 210, which is therefore a flat rectangle in the embodiment illustrated. In some embodiments, the insert 250 may be a flat card to which the garment tabs are stuck via their adhesive sides. In some embodiments, the insert 250 may have a thicker profile (for example, matching the depth of the carrying case in the embodiments) and further may feature one or more cavities or recesses 260 on the top surface of the insert accommodate one or more garment tabs. Each of the cavities 260 is sized and shaped like, or has a footprint of, a garment tab 100 to ensure a snug fit and maintain the garment tabs 100 into place inside the insert 250. In some embodiments, a cavity or recess 260 has the depth to accommodate two or more stacked garment tabs. Further, in embodiments where the insert 250 features multiple cavities or recesses 260, each of the cavities 260 is separated from an adjacent cavity 260 by insert material that serves to cushion the garments tabs 100 from shock against one another.

The carrying case 210, insert 250, and garment tabs 100 combine to provide a garment tab kit 200 that enables storing, maintaining, and carrying garments tabs 100 in a portable and convenient form factor for the wearer. Methods of use are also contemplated such as the use of portable carrier to store and retrieve dress weights when traveling or away from the home. The size of the carrying case is preferably configured to fit into typical or conventional accessary bag. The kit and/or carry case (when loaded with one or more weights) provides an advantageous portable solution. In general, this can be important because people do not plan to have their dress fly up; it just happens. The garment tabs and insert were specifically designed to fit and be properly stored inside the carrying case that easily fits inside women's bags (for example) so that they could travel with the portable solution at all times. The portability is unique for example because the carrying case acts as both the instrument to maintain the usability of the product as well allow it to be used on the go.

It should be understood that combinations of described features or steps are contemplated even if they are not described directly together or not in the same context.

It should also be understood that claims that include fewer recitations, claims without requiring a certain feature or process step in the appended claim or in the specification, clarifications to the claim elements, different combinations, and alternative implementations based on the specification, or different uses, are also contemplated by the embodiments of the present invention.

Terms or words that are used herein, including those that have been provided with specific definitions, are directed to those of ordinary skill in the art in this field of technology and the meaning of those terms or words will be understood from terminology used in the field or that can be reasonably interpreted based on the plain English meaning of the words in conjunction with knowledge in this field of technology. This includes an understanding of implicit features that for example may involve multiple possibilities, but to a person of ordinary skill in the art a reasonable or primary understanding or meaning is understood.

Finally, it should be understood that the above-described embodiments are merely illustrative of some of the many specific examples that represent the principles described herein. Clearly, those skilled in the art can readily devise numerous other arrangements without departing from the scope of the invention as defined by the following claims.

What is claimed is:

1. A kit for storing and carrying weighted garment tabs, comprising:

a carrying case; one or more weighted garment tabs, and an insert configured to snugly fit into the carrying case and configured to accommodate the one or more weighted garment tabs, with one or more of the weighted garment tabs comprising:

a circular disk having first and second surfaces, a diameter between 25 and 40 mm, a peripheral edge, a first rounded corner between the first surface and the peripheral edge, a second rounded corner between the second surface and the peripheral edge, a thickness of between 2 and 2.5 mm and a weight of between 13 and 16 grams;

a coating uniformly covering the peripheral edge, first and second corners, and first and second surfaces of the disk; and a reusable fabric-safe adhesive applied to a central portion of the first surface of the disk and covering an area of 65.79 to 93.75% of that surface of the disk, with a peripheral portion of the first surface adjacent the rounded corner being free of adhesive to assist in removal of the weighted garment tab from the fabric when desired.

2. The kit of claim 1, wherein the carrying case comprises a body portion and a cover portion and the insert is configured to be installed into the body portion.

3. The kit of claim 2, wherein the cover portion comprises a knob configured to assist in opening the carrying case.

4. The kit of claim 2, wherein the body portion further comprises a front wall that extends a portion of the way toward the cover from a side of the body portion to form a pocket.

5. The kit of claim 1, wherein the insert is made of a synthetic plastic polymer.

6. The kit of claim 1, wherein a weighted garment tab of the one or more weighted garment tabs has a thickness of between 2.1 and 2.3 mm and a weight of between 13.5 and 15.5 grams; and the coating comprises a rubberized paint and the adhesive.

7. The kit of claim 1, wherein the insert is configured to serve as a cover for the adhesive that is applied to each garmet tab to preserve the stickiness of the adhesive.

8. The kit of claim 6, wherein the carrying case is sized to accommodate two to twelve garment tabs.

9. A method for storing and carrying weighted garment tabs, comprising:

providing one or more weighted garment tabs; providing a carrying case comprising a body portion and a cover portion; providing an insert configured to snugly fit into the body portion and configured to accommodate the one or more weighted garment tabs; and installing the insert into the body portion, with one or more or each of the weighted garment tabs comprising:

a circular disk having first and second surfaces, a diameter between 25 and 40 mm, a peripheral edge, a first rounded corner between the first surface and the peripheral edge, a second rounded corner between the second surface and the peripheral edge, a thickness of between 2 and 2.5 mm and a weight of between 13 and 16 grams;

a coating uniformly covering the peripheral edge, first and second corners, and first and second surfaces of the disk; and a reusable fabric-safe adhesive applied to a central portion of the first surface of the disk and covering an area of 65.79 to 93.75% of that surface of the disk, with a peripheral portion of the first surface adjacent the rounded corner being free of adhesive to assist in removal of the weighted garment tab from the fabric when desired.

10. The method of claim 9, wherein a weighted garment tab of the one or more weighted garment tabs has a thickness of between 2.1 and 2.3 mm and a weight of between 13.5 and 15.5 grams; and the coating comprises a rubberized paint.

11. The method of claim 9, wherein the insert is made of a synthetic plastic polymer.

12. The method of claim 9, wherein the insert is configured to serve as a cover for the adhesive that is applied to each garmet tab to preserve the stickiness of the adhesive.

13. The kit of claim 1, wherein the adhesive of the one or more weighted garment tabs is a circular spot having a diameter of 25-30 mm and is positioned in the center of the first surface of the disk of each garment tab.

14. The kit of claim 1, wherein each of the weighted garment tabs in the kit comprises:

a circular disk having first and second surfaces, a diameter between 25 to 40 mm, a peripheral edge, a first rounded corner between the first surface and the peripheral edge, a second rounded corner between the second surface and the peripheral edge, a thickness of between 2 and 2.5 mm and a weight of between 13 and 16 grams;

a coating uniformly covering the peripheral edge, first and second corners, and first and second surfaces of the disk; and a reusable fabric-safe adhesive applied to a central portion of the first surface of the disk and covering an area of 65.79 to 93.75% of that surface of the disk, with a peripheral portion of the first surface adjacent the rounded corner being free of adhesive to assist in removal of the weighted garment tab from the fabric when desired.

15. The method of claim 9 wherein the adhesive of the one or more weighted garment tabs is a circular spot having a diameter of 25-30 mm and is positioned in the center of the first surface of the disk of each garment tab.

16. The method of claim 9, wherein each of the weighted garment tabs comprises:

a circular disk having first and second surfaces, a diameter between 25 to 40 mm, a peripheral edge, a first rounded corner between the first surface and the peripheral edge, a second rounded corner between the second surface and the peripheral edge, a thickness of between 2 and 2.5 mm and a weight of between 13 and 16 grams;

a coating uniformly covering the peripheral edge, first and second corners, and first and second surfaces of the disk; and a reusable fabric-safe adhesive applied to a central portion of the first surface of the disk and covering an area of 65.79 to 93.75% of that surface of the disk, with a peripheral portion of the first surface adjacent the rounded corner being free of adhesive to assist in removal of the weighted garment tab from the fabric when desired.

17. The method of claim 9 wherein the carrying case of the kit is sized to accommodate two to twelve garment tabs.

18. The kit of claim 1, wherein the insert is configured to accommodate two to four garment tabs on one side thereof.

19. The kit of claim 1, wherein the insert has a size and shape that allows two to four garment tabs to be adhered thereto via their adhesives.

20. The method of claim 9, wherein the insert has a size and shape that allows two to four garment tabs to be adhered thereto via their adhesives.

* * * * *